US011356760B2

(12) United States Patent
Nakagawa et al.

(10) Patent No.: US 11,356,760 B2
(45) Date of Patent: Jun. 7, 2022

(54) AUDIO DEVICE AND AUDIO REPRODUCTION APPARATUS

(71) Applicant: Sony Corporation, Tokyo (JP)

(72) Inventors: Toshiyuki Nakagawa, Kanagawa (JP); Yoshio Ohashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 17/040,934

(22) PCT Filed: Jan. 23, 2019

(86) PCT No.: PCT/JP2019/001970
§ 371 (c)(1),
(2) Date: Sep. 23, 2020

(87) PCT Pub. No.: WO2019/187547
PCT Pub. Date: Oct. 3, 2019

(65) Prior Publication Data

US 2021/0021919 A1 Jan. 21, 2021

(30) Foreign Application Priority Data

Mar. 30, 2018 (JP) ..... JP2018-069063

(51) Int. Cl.
*H04R 1/02* (2006.01)
*G04B 19/24* (2006.01)
(Continued)

(52) U.S. Cl.
CPC ..... *H04R 1/028* (2013.01); *G04B 19/24* (2013.01); *H04R 7/12* (2013.01); *H04R 17/00* (2013.01); *H04R 2499/15* (2013.01)

(58) Field of Classification Search
CPC ..... H04R 1/028; H04R 7/12; H04R 17/00; H04R 2499/15; H04R 17/005;
(Continued)

(56) References Cited

U.S. PATENT DOCUMENTS 4,709,392 A * 11/1987 Kato ..... H04R 7/26 181/157
6,492,762 B1 * 12/2002 Pant ..... B06B 1/0688 310/334
(Continued)

FOREIGN PATENT DOCUMENTS

CN 101014214 A 8/2007
CN 201063851 Y 5/2008
(Continued)

OTHER PUBLICATIONS

Wu Zonghan, "Electroacoustic Technology",Apr. 30, 2015. Discussion of Micromicroshone Planar Diaphragm Related Problems, full text.
(Continued)

*Primary Examiner* — Andrew L Sniezek
(74) *Attorney, Agent, or Firm* — Wolf, Greenfield & Sacks, P.C.

(57) ABSTRACT

An audio device includes a thin film material having a capacitive property, the thin film material including an acoustic sheet having a curved shape, in which the acoustic sheet includes a first region that is actively driven by an input signal and a second region that is not actively driven by the input signal and the first region is formed in at least a part of an outside of the second region.

14 Claims, 17 Drawing Sheets

(51) Int. Cl.
*H04R 7/12* (2006.01)
*H04R 17/00* (2006.01)

(58) Field of Classification Search
CPC ..... H04R 31/003; H04R 7/22; H04R 7/14; H04R 19/02; H04R 17/125; H04R 2217/01; G04B 19/24
See application file for complete search history.

(56) References Cited

U.S. PATENT DOCUMENTS

| | | | | |
|---|---|---|---|---|
| 7,027,610 | B1 | 4/2006 | Kihara | |
| 2007/0014421 | A1 | 1/2007 | Ohashi et al. | |
| 2007/0223734 | A1* | 9/2007 | Suzuki | H04R 1/345 381/96 |
| 2007/0242844 | A1 | 10/2007 | Harman | |
| 2014/0262599 | A1 | 9/2014 | Bokaemper | |
| 2016/0119719 | A1 | 4/2016 | Doshida et al. | |
| 2017/0105072 | A1 | 4/2017 | Katsumata | |
| 2017/0215846 | A1* | 8/2017 | Sammoura | A61B 8/4494 |
| 2018/0109880 | A1* | 4/2018 | Ozawa | H04R 17/005 |
| 2019/0320262 | A1* | 10/2019 | Nakagawa | H04R 7/125 |

FOREIGN PATENT DOCUMENTS

| | | | |
|---|---|---|---|
| CN | 102316398 | A | 1/2012 |
| CN | 105191349 | A | 12/2015 |
| EP | 1814354 | A1 | 8/2007 |
| EP | 3013069 | A1 | 4/2016 |
| EP | 3163907 | A1 | 5/2017 |
| JP | S57-204799 | U | 12/1982 |
| JP | S59-95488 | A | 6/1984 |
| JP | S60-145792 | U | 9/1985 |
| JP | H09-327093 | A | 12/1997 |
| JP | 2001-045588 | A | 2/2001 |
| JP | 2002281597 | A | 9/2002 |
| JP | 2007-028205 | A | 2/2007 |
| JP | 2007-228557 | A | 9/2007 |
| JP | 2011-130366 | A | 6/2011 |
| JP | 2011151760 | * | 8/2011 |
| JP | 2016-012777 | A | 1/2016 |
| JP | 2016-086414 | A | 5/2016 |
| KR | 20150072775 | A | 6/2015 |
| WO | WO 2007/024943 | A1 | 3/2007 |
| WO | WO 2009/107305 | A1 | 9/2009 |
| WO | WO-2017053716 | A1 | 3/2017 |

OTHER PUBLICATIONS

International Search Report and Written Opinion and English translations thereof dated Apr. 16, 2019 in connection with International Application No. PCT/JP2019/001970.
International Preliminary Report on Patentability and English translation thereof dated Oct. 15, 2020 in connection with International Application No. PCT/JP2019/001970.

* cited by examiner

AUDIO DEVICE AND AUDIO REPRODUCTION APPARATUS

CROSS-REFERENCE TO RELATED APPLICATIONS

This application claims the benefit under 35 U.S.C. § 371 as a U.S. National Stage Entry of International Application No. PCT/JP2019/001970, filed in the Japanese Patent Office as a Receiving Office on Jan. 23, 2019, which claims priority to Japanese Patent Application Number JP2018-069063, filed in the Japanese Patent Office on Mar. 30, 2018, each of which is hereby incorporated by reference in its entirety.

TECHNICAL FIELD

The present disclosure relates to an audio device and an audio reproduction apparatus.

BACKGROUND ART

There is known a device using a piezoelectric material as one of audio devices. Patent Literature 1 and Patent Literature 2 have each disclosed such an audio device using a piezoelectric material.

CITATION LIST

Patent Literature

Patent Literature 1: Japanese Patent Application Laid-open No. SHO 59-158199

Patent Literature 2: Japanese Patent Application Laid-open No. 2011-97181

DISCLOSURE OF INVENTION

Technical Problem

In such fields, it is desirable to realize favorable acoustic characteristics.

Solution to Problem

The present disclosure provides, for example, an audio device, including a thin film material having a capacitive property, the thin film material including an acoustic sheet having a curved shape, in which the acoustic sheet includes a first region that is actively driven by an input signal and a second region that is not actively driven by the input signal and the first region is formed in at least a part of an outside of the second region.

The present disclosure provides, for example, an audio reproduction apparatus, including:

an acoustic sheet having a curved shape, the acoustic sheet being a thin film material having a capacitive property; and a fixation portion with which the acoustic sheet is fixed, in which the acoustic sheet includes a first region that is actively driven by an input signal and a second region that is not actively driven by the input signal and the first region is formed in at least a part of an outside of the second region.

Advantageous Effects of Invention

In accordance with at least one embodiment of the present disclosure, it is possible to realize favorable acoustic characteristics in an audio device or an audio reproduction apparatus using a thin film material having a capacitive property. The effects described herein are not necessarily limited and may be any of the effects described in the present disclosure. Further, the contents of the present disclosure are not to be construed as being limited by the illustrated effects.

MODE(S) FOR CARRYING OUT THE INVENTION

Hereinafter, embodiments and the like of the present disclosure will be described below with reference to the drawings. It should be noted that the descriptions are made in the following order.

<1. First Embodiment>
<2. Second Embodiment>
<3. Third Embodiment>
<4. Fourth Embodiment>
<5. Fifth Embodiment>
<6. Sixth Embodiment>
<7. Modified Example>

The embodiments and the like described below are favorable specific examples of the present disclosure and the contents of the present disclosure are not limited to these embodiments.

1. First Embodiment

Configuration of First Embodiment

Figure 1:
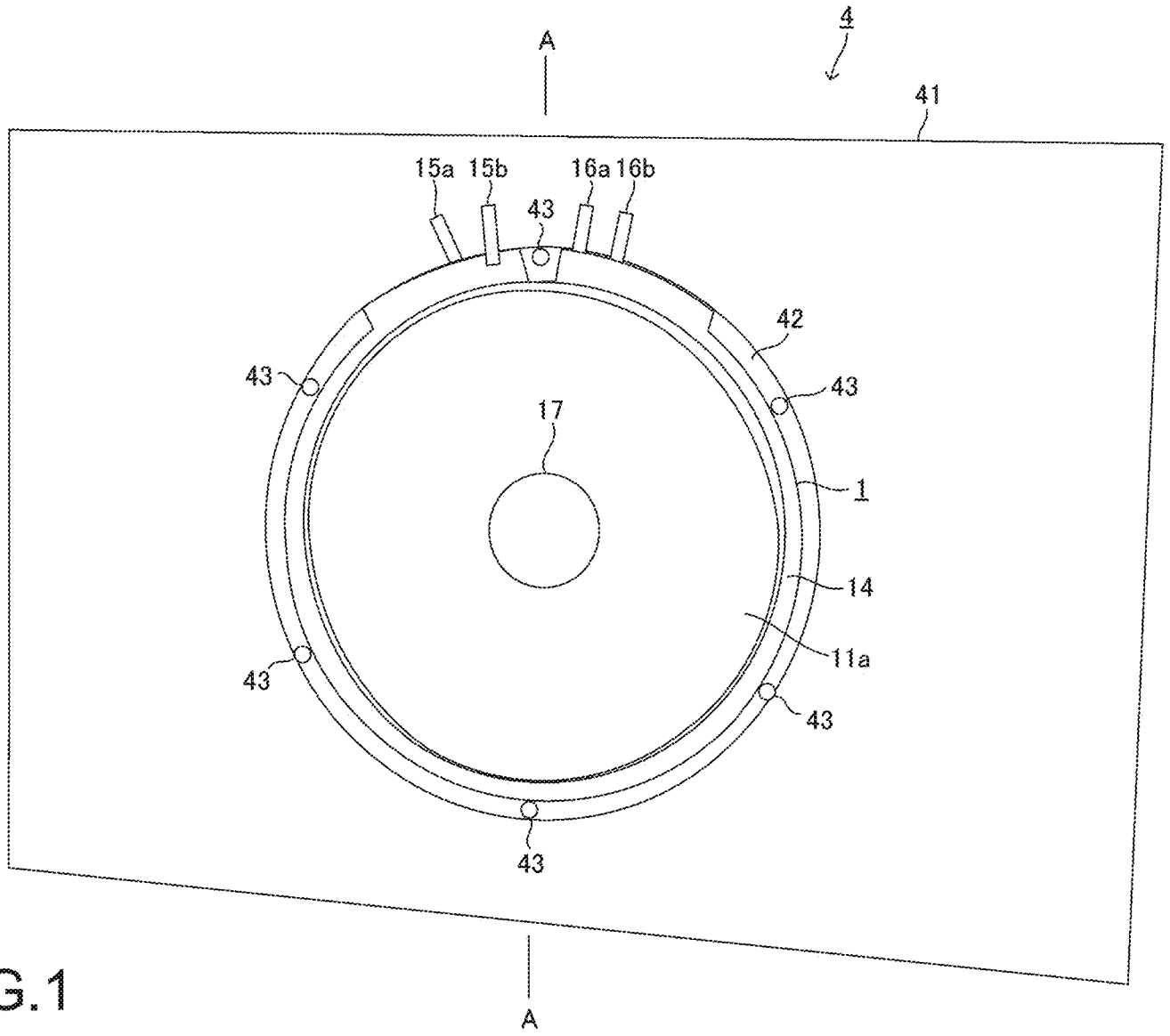
FIG. 1 is a front perspective view showing an outer appearance of an audio reproduction apparatus.
Figure 2:
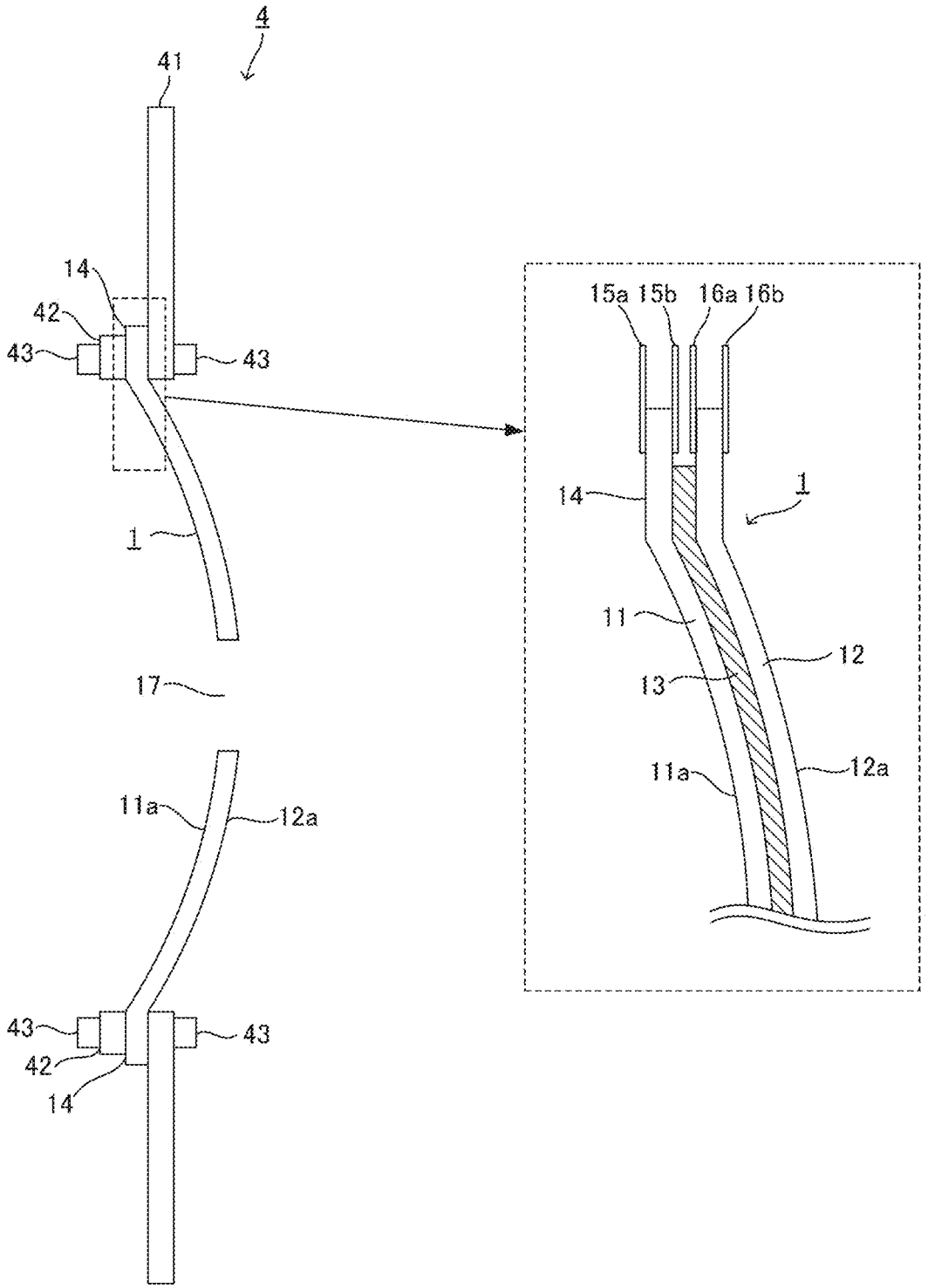
FIG. 2 is a cross-sectional view of the audio reproduction apparatus and a cross-sectional view of an audio device.

FIG. 1 is a front perspective view showing an outer appearance of an audio reproduction apparatus 4. FIG. 2 is a cross-sectional view taken along the line A-A shown in FIG. 1 and is a cross-sectional view of an audio device 1. The audio reproduction apparatus 4 in accordance with the present embodiment includes the audio device 1, a frame base 41, a frame ring 42, and a fixtures 43.

The frame base 41 is a thin plate-like member and is provided with a fixation hole for fixing the audio device 1 at the center. In the audio reproduction apparatus 4 in accordance with the present embodiment, it corresponds to a fixation portion that fixes the audio device 1. Further, the frame base 41 forms a baffle surface in the periphery of a vibration front surface 11*a* of the audio device 1.

The shape of the audio device 1 as viewed from the front surface is a substantially circular shape. The audio device 1 is provided with a hole 17 at the center, the hole 17 communicating in a front-rear direction. The audio device 1 is provided with a holding portion 14 extending in an outer peripheral direction and fixes the frame base 41 to the audio device 1 by the use of this holding portion 14. Specifically, the audio device 1 is arranged in the fixation hole of the frame base 41 and the annular frame ring 42 is arranged to hold the holding portion 14. Then, the frame ring 42 and the frame base 41 are fixed with the plurality of fixtures 43. In the present embodiment, fasteners such as bolts and nuts are used as the fixtures 43. In this way, the audio device 1 can be fixed to the frame base 41 without hindering vibration for sound radiation in the audio device 1.

Next, details of the audio device 1 will be described. FIG. 2 shows a cross-sectional view of the audio device 1 in the portion surrounded with the broken line in the cross-sectional view of the audio reproduction apparatus 4. The audio device 1 according to the present embodiment includes the vibration front surface 11*a* which is on a sound radiation side and a vibration rear surface 12*a* opposite to the sound radiation side. The audio device 1 according to the present embodiment is configured by bonding a first acoustic sheet 11, a reinforcing sheet 13, and a second acoustic sheet 12 together in the stated order from a side of the vibration front surface 11*a*.

Each of the first acoustic sheet 11 and the second acoustic sheet 12 among of them is formed of a film-like piezoelectric material. A polymer composite piezoelectric material in which a polymer ceramic is dispersed, for example, is used as the piezoelectric material. The first acoustic sheet 11 (or the second acoustic sheet 12) formed of the piezoelectric material is provided with electrodes 15*a* and 15*b* (or 16*a* and 16*b*). By a signal being applied thereto, the piezoelectric material is stretched or contracted. It should be noted that not only the piezoelectric material but also various materials such as a capacitive film can be used as the first acoustic sheet 11 (or the second acoustic sheet 12) as long as it is a thin film material having a capacitive property.

Further, the first acoustic sheet 11 (or the second acoustic sheet 12) has a curved shape and is capable of converting the stretching and contraction of the piezoelectric material into air vibration and uses them as an acoustic output. In the examples of FIG. 1 and FIG. 2, the vibration front surface 11*a* of the audio device 1 has a spherical coronal shape, i.e., a concave shape obtained by cutting the spherical surface in a plane. It should be noted that not only the shape curved in the concave shape in the sound radiation direction in this manner, but also various shapes such as a shape curved in a convex shape in the sound radiation direction can be employed as the curved shape of the vibration front surface 11*a*. Further, in this embodiment, the first acoustic sheet 11 and the second acoustic sheet 12 are used for enhancement of the sound pressure in the audio device 1. For the first acoustic sheet 11 and the second acoustic sheet 12, a polarization direction and signal application to the electrodes 15*a* and 15*b* (or 16*a* and 16*b*) are set such that those vibrate in the same phase. It should be noted that the audio device 1 can also be constituted by one acoustic sheet or three or more acoustic sheets. In a case where it is constituted by a plurality of acoustic sheets, it is favorable that the reinforcing sheet 13 is provided between the respective acoustic sheets.

Further, the reinforcing sheet 13 is provided between the first acoustic sheet 11 and the second acoustic sheet 12. The reinforcing sheet 13 is a sheet-like member for reinforcing the shape of the audio device 1. In the present embodiment, a nonwoven fabric having excellent air permeability is used in consideration of the convenience of the manufacturing process. The reinforcing sheet 13 is fixed to the first acoustic sheet 11 and the second acoustic sheet 12 with an adhesive or the like. It should be noted that various materials such as a plastic plate as well as the nonwoven fabric can be used for the reinforcing sheet 13.

The electrodes 15*a* and 15*b* (or 16*a*, 16*b*) are signal input units for driving the first acoustic sheet 11 (or the second acoustic sheet 12). In the present embodiment, as shown in FIG. 1, those are provided in an upper portion of the audio device 1. It should be noted that although the electrodes 15*a* and 15*b* (or 16*a*, 16*b*) are exposed to the front surface of the audio reproduction apparatus 4 in the present embodiment, the electrodes 15*a* and 15*b* (or 16*a*, 16*b*) are shielded or provided on the back surface of the frame base 41 in the actual product. Further, removing positions for the electrodes 15*a* and 15*b* (or 16*a*, 16*b*) can be appropriate positions in the periphery of the first acoustic sheet 11 (or the second acoustic sheet 12).

The audio device 1 according to the present embodiment has the spherical coronal shape and is provided with the hole 17 at the center, the hole 17 communicating the front and back. In the present embodiment, the diameter of the audio device 1 is 320 mm and the diameter of the hole 17 is 30 mm. This hole 17 has an acoustic adjustment function and contributes to a reduction in thickness of the audio device 1. That is, by providing the hole 17, the top of the spherical coronal shape of the audio device 1 is cut and a reduction in thickness of the audio device 1 is achieved. In this manner, the audio device 1 includes a first region that is actively driven by the first acoustic sheet 11 and the second acoustic sheet 12 and a second region that is not actively driven, the second region being provided with the hole 17.

[Molding Method for Acoustic Sheet]

Figure 3:
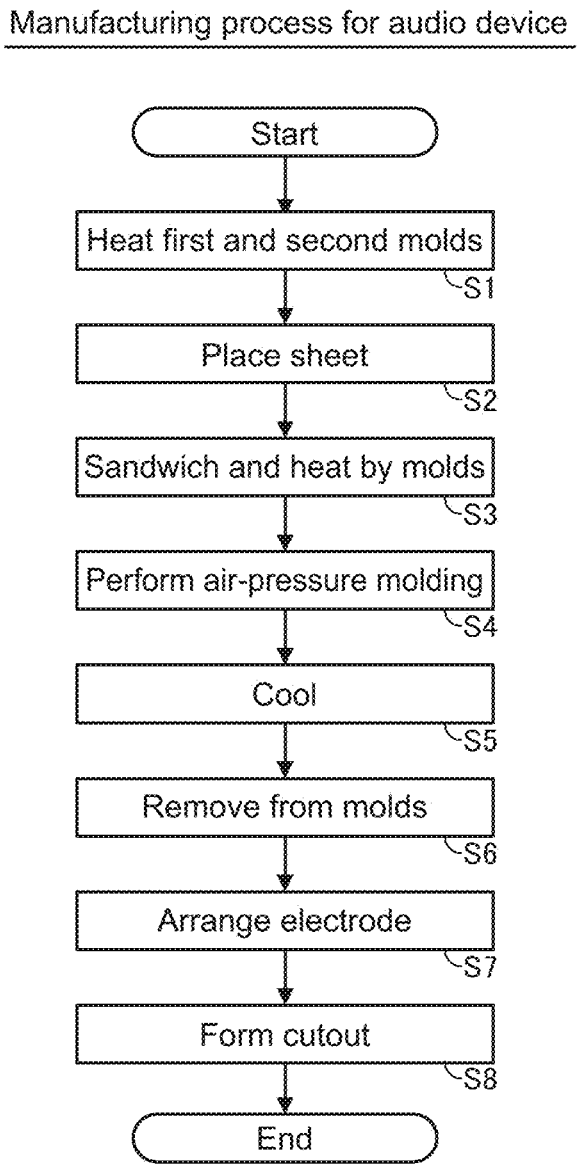
FIG. 3 is a flowchart showing a manufacturing process for the audio device.

FIG. 3 is a flowchart showing a manufacturing process for the acoustic sheet. In the audio device 1 in FIG. 1 and FIG. 2, the first acoustic sheet 11 and the second acoustic sheet 12 are used and manufacturing processes for both are similar, and thus the manufacturing process for the acoustic sheet will be described. It should be noted that although an air-pressure molding method is used in the manufacturing process for the acoustic sheet in the present embodiment, the manufacturing method for the acoustic sheet is not limited to the air-pressure molding method and a press molding method, a vacuum molding method, or a molding method combining these methods may be used.

In the present embodiment, a first mold having a three-dimensional shape and a predetermined depth, a second mold serving as a receiving side of the first mold, and an acoustic sheet to be molded are necessary for molding processing. It should be noted that the acoustic sheet before molding is not provided with the electrodes and the electrodes are provided after molding.

In Step S1, the first mold and the second mold are heated. The temperature for heating is set in consideration of the characteristics of the piezoelectric material to be used. Here, the set temperature is set to a temperature lower than the Curie point, so that the disappearance of piezoelectricity does not occur.

In Step S2, the acoustic sheet is placed on the heated first mold.

In Step S3, the second die is placed from above the acoustic sheet placed on the first die. Then, airtightness at a predetermined level or more is applied thereon by pressing. Thereafter, the pressed acoustic sheet is heated. The time for heating the acoustic sheet is set in consideration of the characteristics and the like of the acoustic sheet to be used.

In Step S4, air-pressure molding is performed. In this step, by adding a predetermined air pressure from the side of the second mold for example, the acoustic sheet is press-bonded to the side of the first mold and molded into the three-dimensional shape having the predetermined depth.

Here, in an air-pressure molding machine used in the molding method for the acoustic sheet according to the present embodiment, the second mold arranged in the upper side has a structure capable of adding a pressure by feeding gas from the back. Further, the first mold is provided with small downward through-holes as appropriate and configured to be capable of allowing the air existing between the placed various sheets and the first mold that is a pressed side in the air-pressure step to escape.

The surface of the acoustic sheet constituted by the piezoelectric material is generally formed of a resin film having very low air permeability such as polyethylene terephthalate, polyethylene naphthalate, polyimide, polyetherimide, and polycarbonate. Therefore, by employing a configuration in which the air can escape in the molding processing step, the surface of the acoustic sheet is more favorably bonded to the side of the first mold.

In Step S5, the entire material is cooled with the pressure applied. The shape of the acoustic sheet molded at a predetermined temperature in the above-mentioned process can be kept.

In Step S6, the molded acoustic sheet is removed from the molds still in an integrated state. As described above, it is possible to mold the acoustic sheet into the three-dimensional shape having the predetermined depth.

In Step S7, a machining process such as cutting according to the shape of the holding portion 14 and forming electrodes is further performed.

In Step S8, a hole having a predetermined size is formed at a predetermined position. For example, in a case of the first acoustic sheet 11 of FIG. 2, the diameter of the first acoustic sheet 11 is 160 mm and a hole 17 having a diameter of 30 mm substantially at the center is provided using a cutting means such as a cutter.

Although molding of the acoustic sheet has been described, the reinforcing sheet 13 used in the audio device 1 of FIG. 2 may also be subjected to the molding processing in accordance with steps similar to those for the acoustic sheet. As the material of the reinforcing sheet 13, for example, a material having air permeability such as a nonwoven fabric is desirable. If the material has high air permeability, the air can be made to escape in the molding processing step, so that it is possible to more favorably adhere to the molds at the time of molding processing, and molding accuracy can be enhanced.

[Frequency Characteristic According to First Embodiment]

Figure 4:
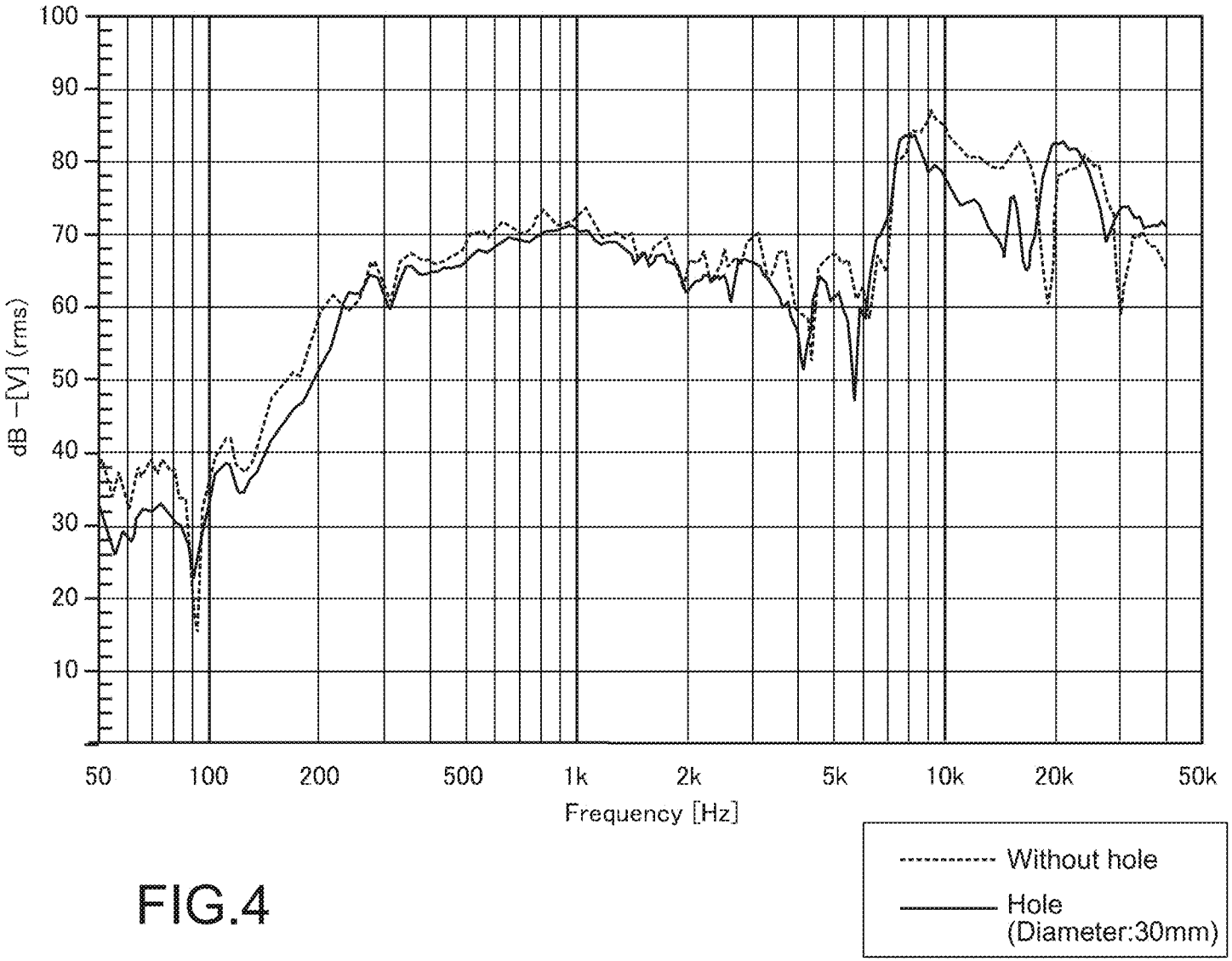
FIG. 4 is a diagram showing frequency characteristics of the audio reproduction apparatus.

FIG. 4 is a diagram showing frequency characteristics of the audio reproduction apparatus 4 in accordance with the first embodiment. The two frequency characteristics are shown in FIG. 4, of which the frequency characteristic according to the first embodiment is shown as the solid line. For reference, the frequency characteristic of the audio reproduction apparatus 4 not provided with the hole 17 is shown as the broken line. The configuration is the same except that the hole 17 is not provided. In the first embodiment in which the hole 17 is provided, although a slight decrease in the sound pressure is observed compared with the case where the hole 17 is not provided, the peak dip is eliminated in the entire frequency. In particular, roughness (disturbance) of the frequency characteristic is suppressed for flattening in the high-frequency and low-frequency ranges, and the improvement of the frequency characteristic is observed.

Thus, in the audio reproduction apparatus 4 in accordance with the present embodiment, a first region that is actively driven by an input signal and a second region that is not actively driven by the input signal, are formed inside the acoustic sheet by providing the hole 17 in the audio device 1 to be used, the second region being formed inside the first region. Thus, it is possible to improve the sound quality. Further, by providing the hole 17, it is also possible to reduce the thickness of the audio device 1 as compared with the case where the hole 17 is not provided.

2. Second Embodiment

Configuration of Second Embodiment

By the way, in the first embodiment, the vibration front surface 11*a* of the audio device 1 and the vibration rear surface 12*a* radiate sounds of opposite phases. Since the audio device 1 is provided with the hole 17, it is conceivable that the sound of the vibration rear surface 12*a* radiated from the hole 17 cancel the sound radiated from the vibration front surface 11*a*.

Figure 5:
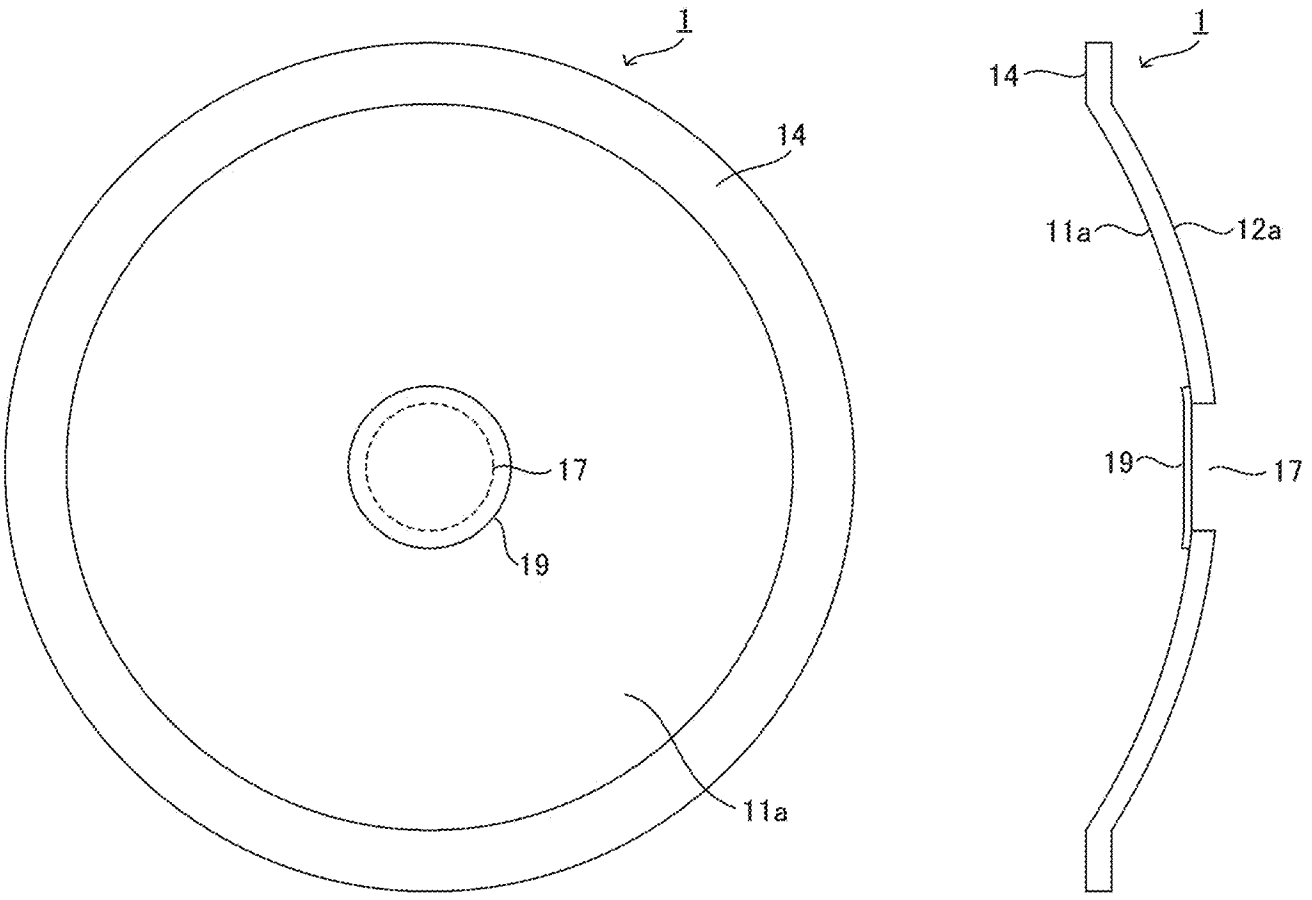
FIG. 5 is a front view and is a cross-sectional view of the audio device.

In order to suppress such sound cancellation due to the hole 17, the second embodiment employs a configuration in which the audio device 1 similar to that of the first embodiment is provided with a closing portion 19 that closes the hole 17. FIG. 5A is a diagram showing a front view of the audio device 1 and FIG. 5B is a diagram showing a cross-sectional view with respect to the second embodiment. The closing portion 19 is slight larger than the hole 17 and is fixed with an adhesive in the periphery of the hole 17. It should be noted that the configuration as the audio reproduction apparatus 4 is similar to that of the first embodiment.

The closing portion 19 is a member provided in order to suppress the sound of the vibration rear surface 12*a* radiated from the hole 17 as described above and paper is used therefor in the present embodiment. Alternatively, various materials such as a cloth, a nonwoven fabric, a plastic plate, and the like can be used for the closing portion 19. It should be noted that it is favorable to use a flexible material for the closing portion 19 not to hinder vibration of the audio device 1.

Although the closing portion 19 is fixed so as to close the hole 17 in the present embodiment, various forms can be employed for the closing portion 19 that closes the hole 17. For example, the closing portion 19 may be fixed on a side of the vibration rear surface 12*a*. Alternatively, instead of providing the closing portion 19, the reinforcing sheet 13 may be provided with the function of the closing portion 19 in the first embodiment shown in FIG. 2 without penetrating a portion of the reinforcing sheet 13, which corresponds to the position of the hole 17. Alternatively, it is for example conceivable to employ the region that is not actively driven as a region not polarized or where no signal is applied for the position of the hole 17 in the first acoustic sheet 11 and the second acoustic sheet 12. In either case, the first region that is actively driven by the input signal and the second region that is not actively driven by the input signal are formed on roughly similar surfaces in the acoustic sheets 11 and 12, the second region being formed inside the first region. It should be noted that the first region and the second region are not necessarily formed on the similar surfaces as shown in FIG. 5A and FIG. 5B, and various shapes can be employed as long as the first region is formed in at least a part of an outside of the second region.

[Frequency Characteristic According to Second Embodiment]

Figure 6:
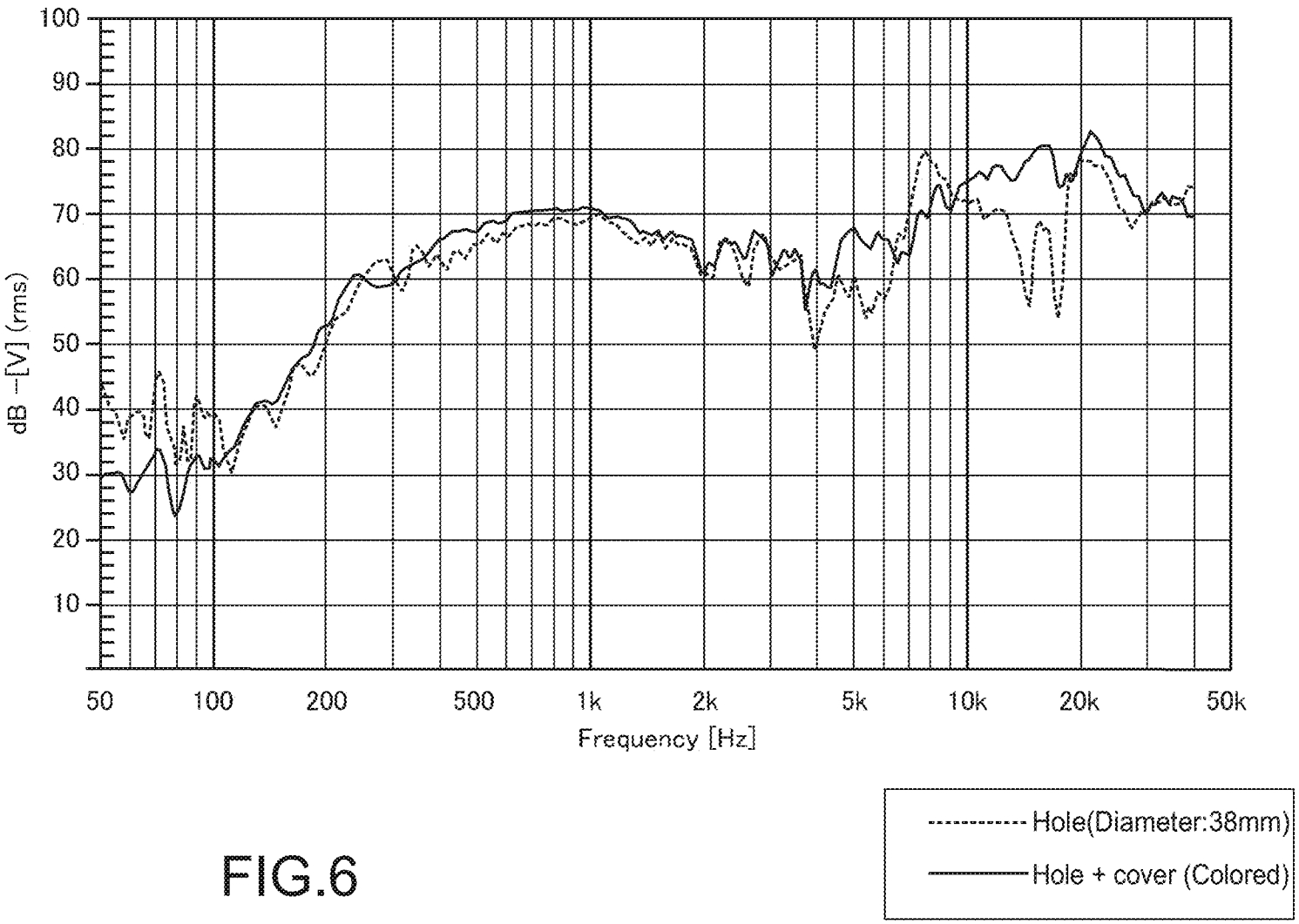
FIG. 6 is a diagram showing frequency characteristics of the audio reproduction apparatus.

FIG. 6 is a diagram showing the frequency characteristics of the audio reproduction apparatus 4 in accordance with a second embodiment. The second embodiment takes a configuration similar to that of the first embodiment and is different from the first embodiment in that the diameter of the hole 17 is as large as 38 mm. Further, in the second embodiment, the form in which the entire vibration front surface 11*a* is colored is employed.

Two frequency characteristics are shown in FIG. 6, of which the frequency characteristic according to the second embodiment is shown as the solid line. For reference, the frequency characteristic of the audio reproducing apparatus 4 in which a closing portion 19 is not provided in the hole 17 is shown as the broken line. The configuration is the same except that the closing portion 19 is not provided. In the second embodiment (solid line), the closing portion 19 is provided and enhancement of the sound pressure as a whole is achieved as compared with the one in which the hole 17 is merely provided (broken line). Further, the peak dip of the frequency is suppressed and further enhancement of the frequency characteristic is achieved. It is considered that it is because the sound radiation from the back surface from the hole 17 is suppressed by providing the closing portion 19, the cancellation of the sound radiated from the front surface is suppressed. Further, although the form in which the entire vibration front surface 11*a* is colored is employed in the second embodiment, a large change in the frequency characteristic due to the coloring cannot be observed, and it can be seen that the influence of the coloring is small.

3. Third Embodiment

Configuration of Third Embodiment

Figure 7:
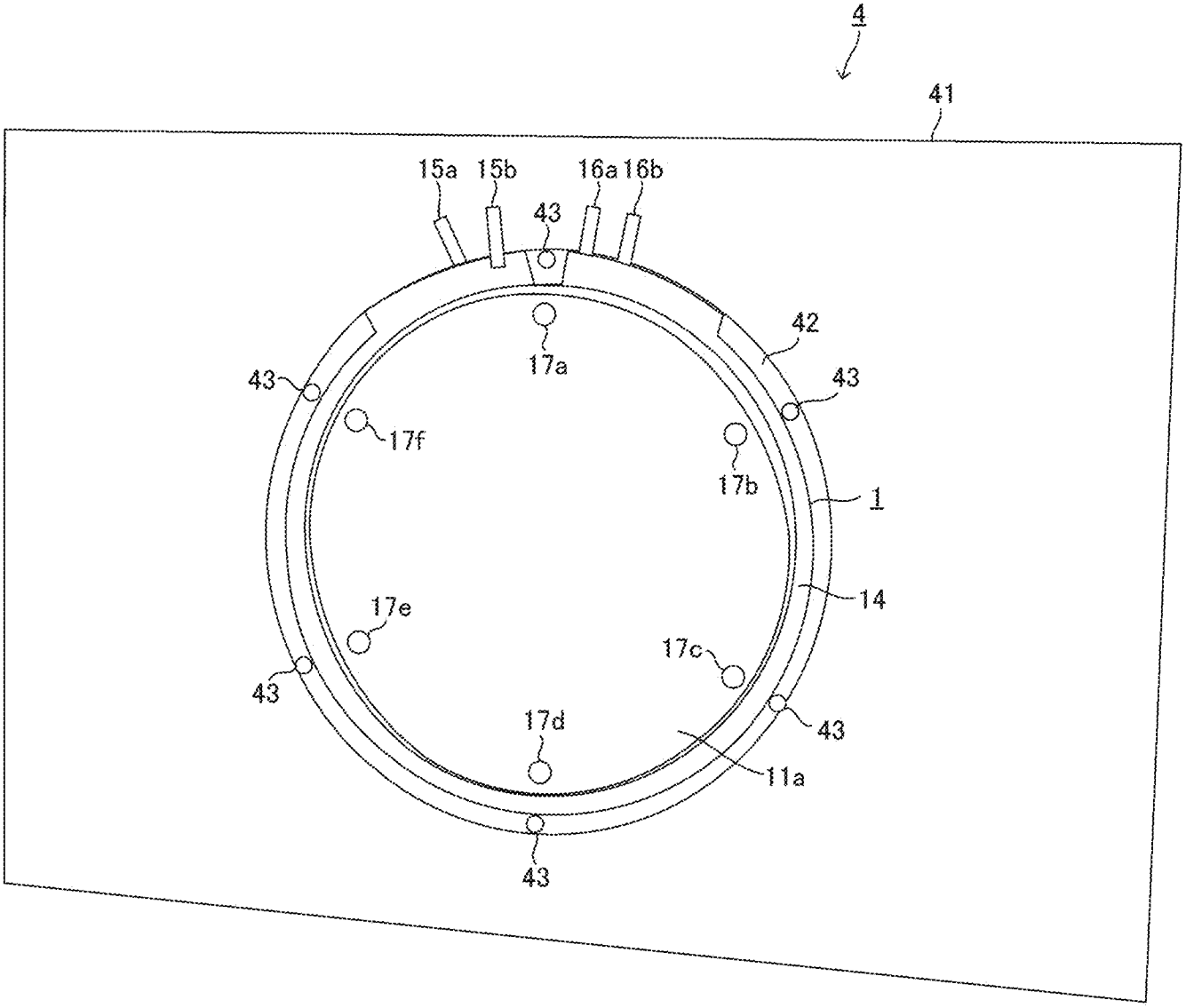
FIG. 7 is a front perspective view showing an outer appearance of the audio reproduction apparatus.

In the first and second embodiments, the number of holes 17 is one and the hole 17 is provided substantially at the center of the audio device 1. However, the number of holes 17 and the position of the hole(s) 17 can be appropriate. FIG. 7 is a front perspective view of the audio device 1 according to a third embodiment. In the present embodiment, holes 17*a* to 17*f* at six positions are provided in the periphery of the audio device 1, i.e., positions different from the coaxial position in the audio device 1. As in the first embodiment, the holes 17*a* to 17*f* pass through the front and rear of the audio device 1. The diameter of each of the holes 17*a* to 17*f* is 6 mm.

[Frequency Characteristic According to Third Embodiment]

Figure 8:
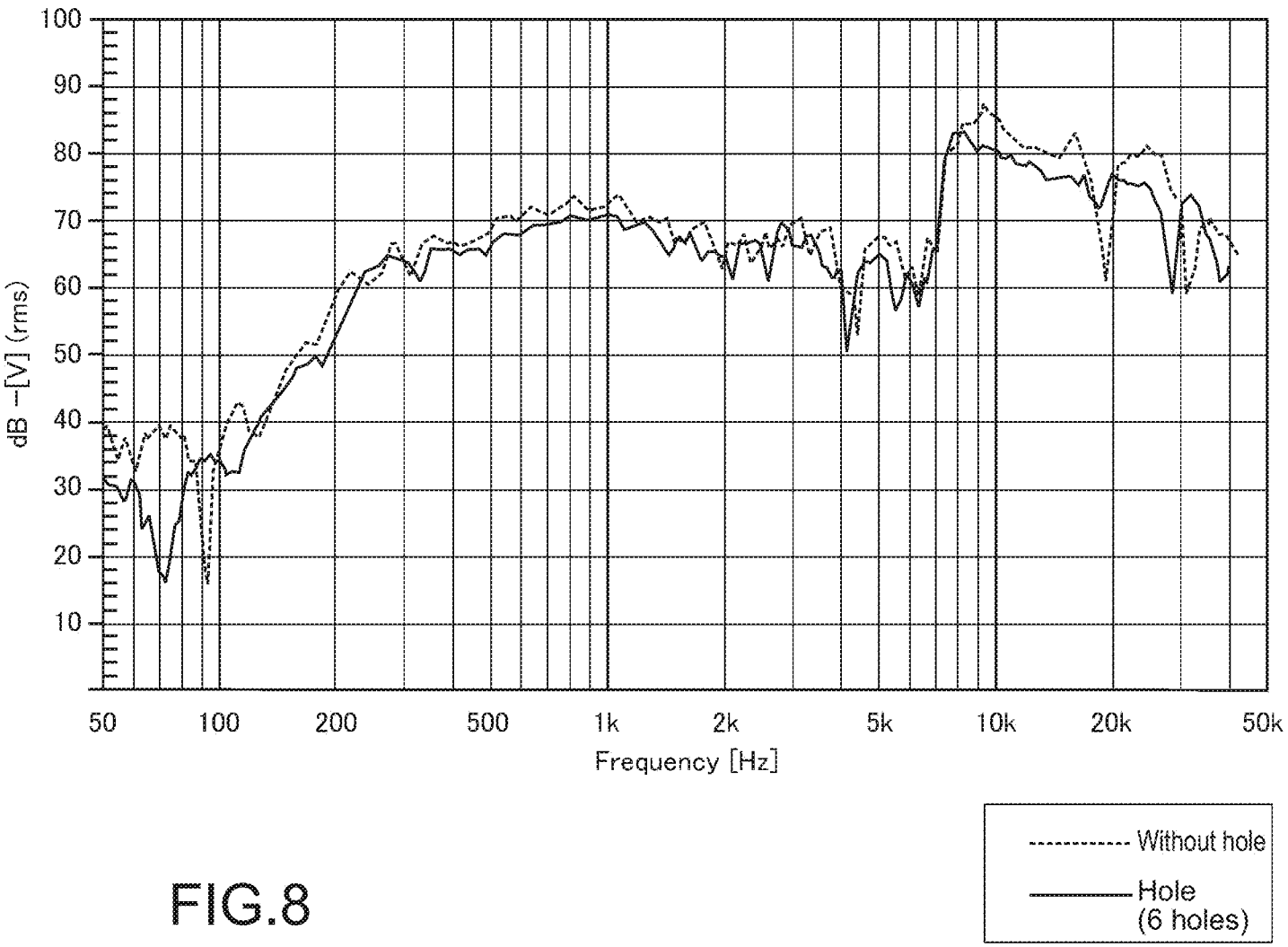
FIG. 8 is a diagram showing frequency characteristics of the audio reproduction apparatus.

FIG. 8 is a diagram showing a frequency characteristic of the audio reproduction apparatus 4 in accordance with the third embodiment. In two frequency characteristics shown in FIG. 8, the frequency characteristic according to the third embodiment is shown as the solid line. Further, the frequency characteristic of the audio reproducing apparatus 4 in a case where the holes 17*a* to 17*f* are not provided is shown as the broken line for reference. As in the first embodiment, in the first embodiment in which the holes 17*a* to 17*f* are provided, although a slight decrease in the sound pressure is observed compared with the case where the holes 17*a* to 17*f* are not provided, roughness (disturbance) of the frequency characteristic is suppressed for flattening in the high-frequency and low-frequency ranges, and the improvement of the frequency characteristic is observed.

4. Fourth Embodiment

Configuration of Fourth Embodiment

Figure 9:
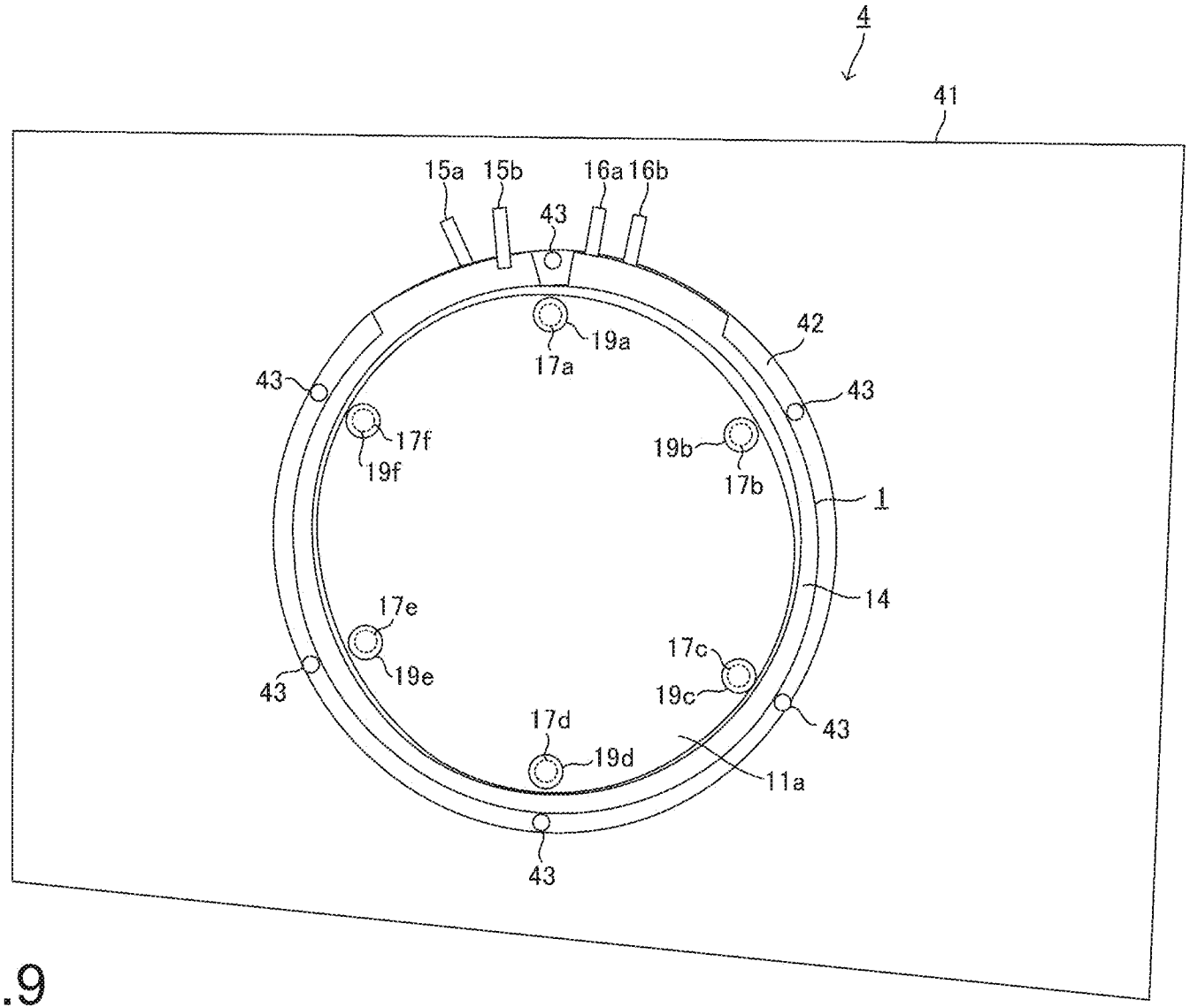
FIG. 9 is a front perspective view showing an outer appearance of the audio reproduction apparatus.

In order to suppress the sound cancellation due to the holes 17*a* to 17*f* with respect to the third embodiment, a fourth embodiment employs a configuration in which the audio device 1 similar to that of the third embodiment is provided with the closing portions 19*a* to 19*f* that close the holes 17*a* to 17*f*. FIG. 9 is a front perspective view showing the audio reproduction apparatus 4 in accordance with the fourth embodiment. Flexible materials such as paper are used for the closing portions 19*a* to 19*f*, which are slightly larger in size than the holes 17*a* to 17*f* and is fixed in the peripheries of the holes 17*a* to 17*f* with adhesives.

5. Fifth Embodiment

Configuration of Fifth Embodiment

Figure 10:
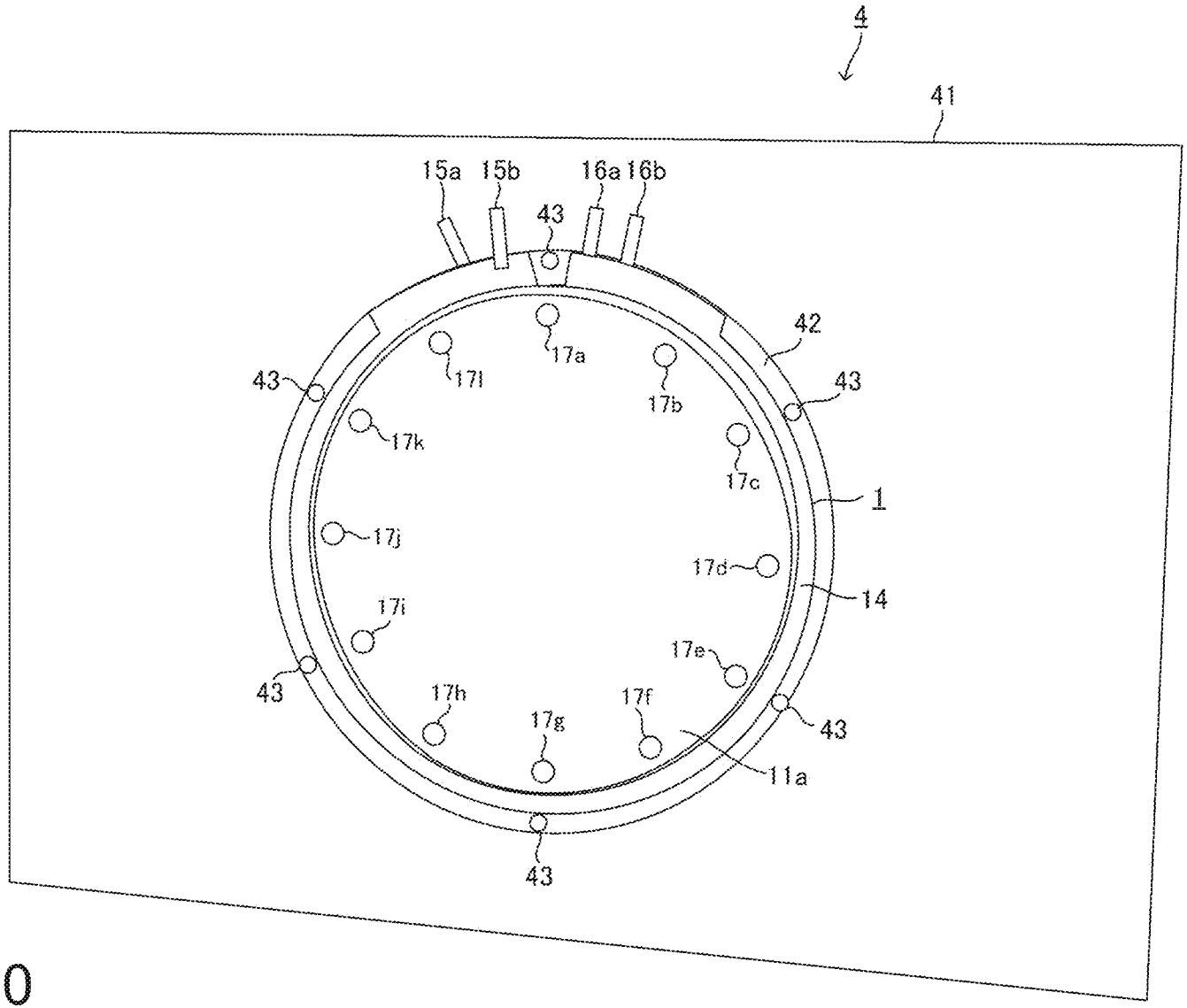
FIG. 10 is a front perspective view showing an outer appearance of the audio reproduction apparatus.

FIG. 10 is a front perspective view of the audio device 1 according to a fifth embodiment. In the present embodiment, holes 17*a* to 17*l* at twelve positions are provided in the periphery of the audio device 1, i.e., positions different from the coaxial position in the audio device 1. As in the first embodiment, the holes 17*a* to 17*l* pass through the front and rear of the audio device 1. The diameter of each of the holes 17*a* to 17*l* is 6 mm.

[Frequency Characteristic According to Fifth Embodiment]

Figure 11:
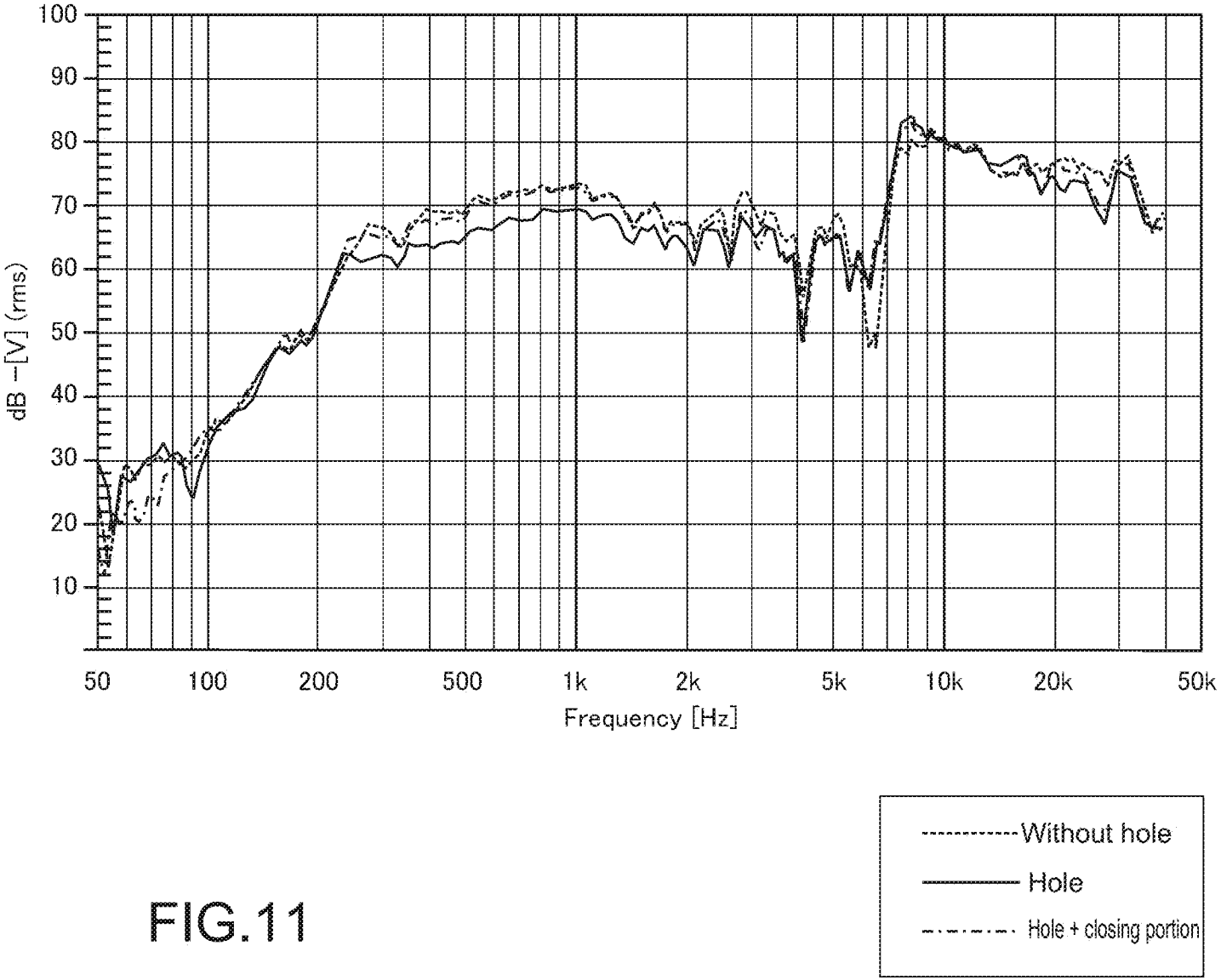
FIG. 11 is a diagram showing frequency characteristics of the audio reproduction apparatus.

Three frequency characteristics are shown in FIG. 11, of which the frequency characteristic of the fifth embodiment is shown as the solid line. For reference, the frequency characteristic of the audio reproduction apparatus 4 in which the holes 17*a* to 17*l* are not provided is shown as the broken line. The configuration is the same except that the holes 17*a* to 17*l* are not provided. In the fifth embodiment (solid line), although the sound pressure as a whole tends to decrease as compared with the one not provided with the holes 17*a* to 17*l* (dashed line), improvement of the frequency characteristics can be observed in the frequency band such as the mid-range. Further, since there is no difference in the characteristic at frequencies lower than about 230 Hz, the reproduction limit of the low frequency range in the audio device 1 can be relatively extended.

6. Sixth Embodiment

Configuration of Sixth Embodiment

Figure 12:
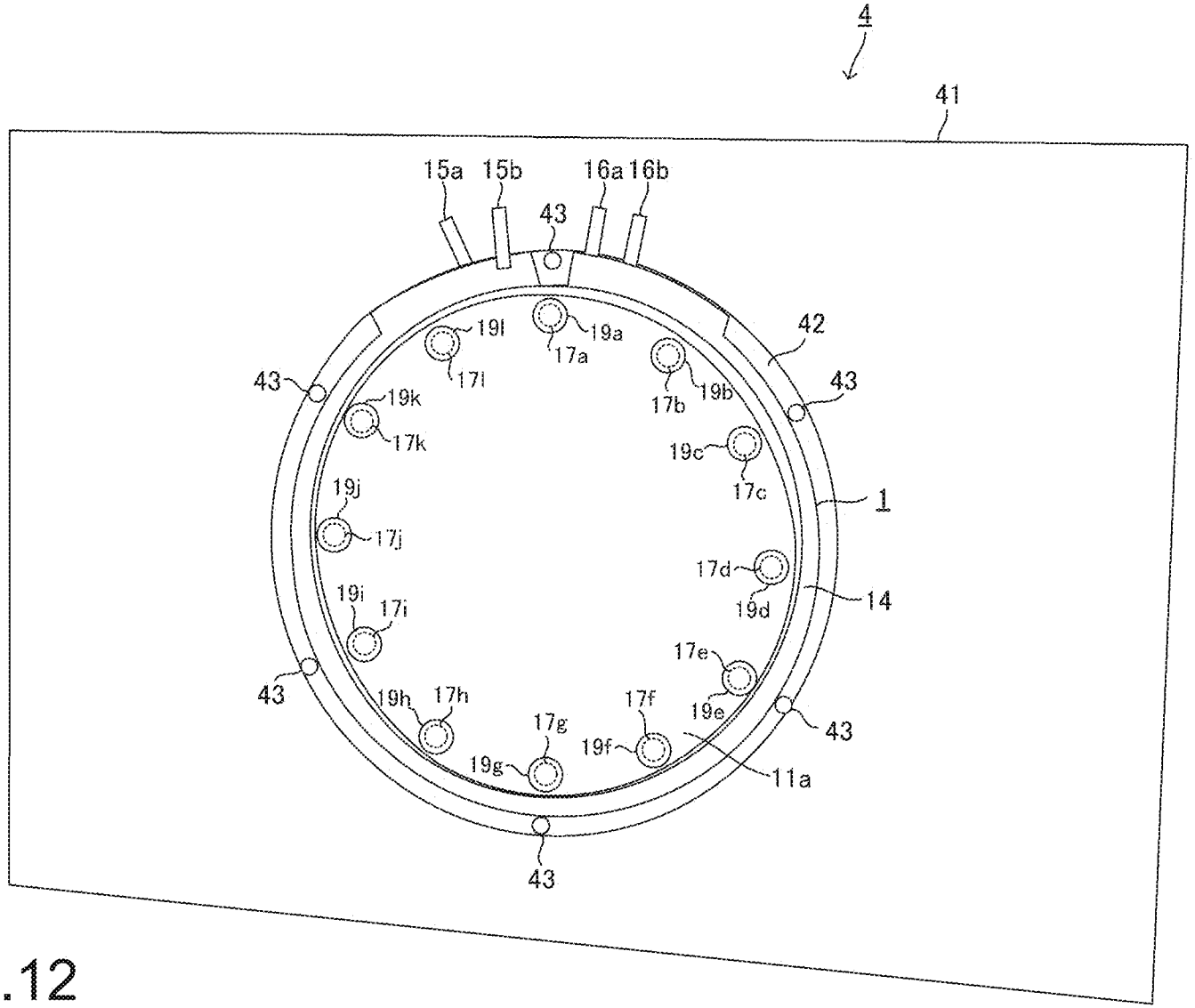
FIG. 12 is a front perspective view showing an outer appearance of the audio reproduction apparatus.

In order to suppress the sound cancellation due to the holes 17*a* to 17*l* with respect to the fifth embodiment, a sixth embodiment employs a configuration in which the audio device 1 similar to that of the fifth embodiment is provided with closing portions 19*a* to 19*l* that close the holes 17*a* to 17*l*. FIG. 12 is a front perspective view showing the audio reproduction apparatus 4 in accordance with the sixth embodiment. Flexible materials such as paper are used for the closing portions 19*a* to 19*l*, which are slightly larger in size than the holes 17*a* to 17*l* and is fixed in the peripheries of the holes 17*a* to 17*l* with adhesives.

[Frequency Characteristic According to Sixth Embodiment]

Among the three frequency characteristics shown in FIG. 11, the frequency characteristic according to the sixth embodiment is shown as the long dashed short dashed line. The configuration is the same as the fifth embodiment except that the closing portions 19*a* to 19*l* are not provided. In the sixth embodiment (long dashed short dashed line), improvement of the sound pressure as a whole is achieved as compared with the fifth embodiment (solid line) in which the closing portions 19*a* to 19*l* are not provided.

7. Modified Example

First Modified Example

Figure 13:
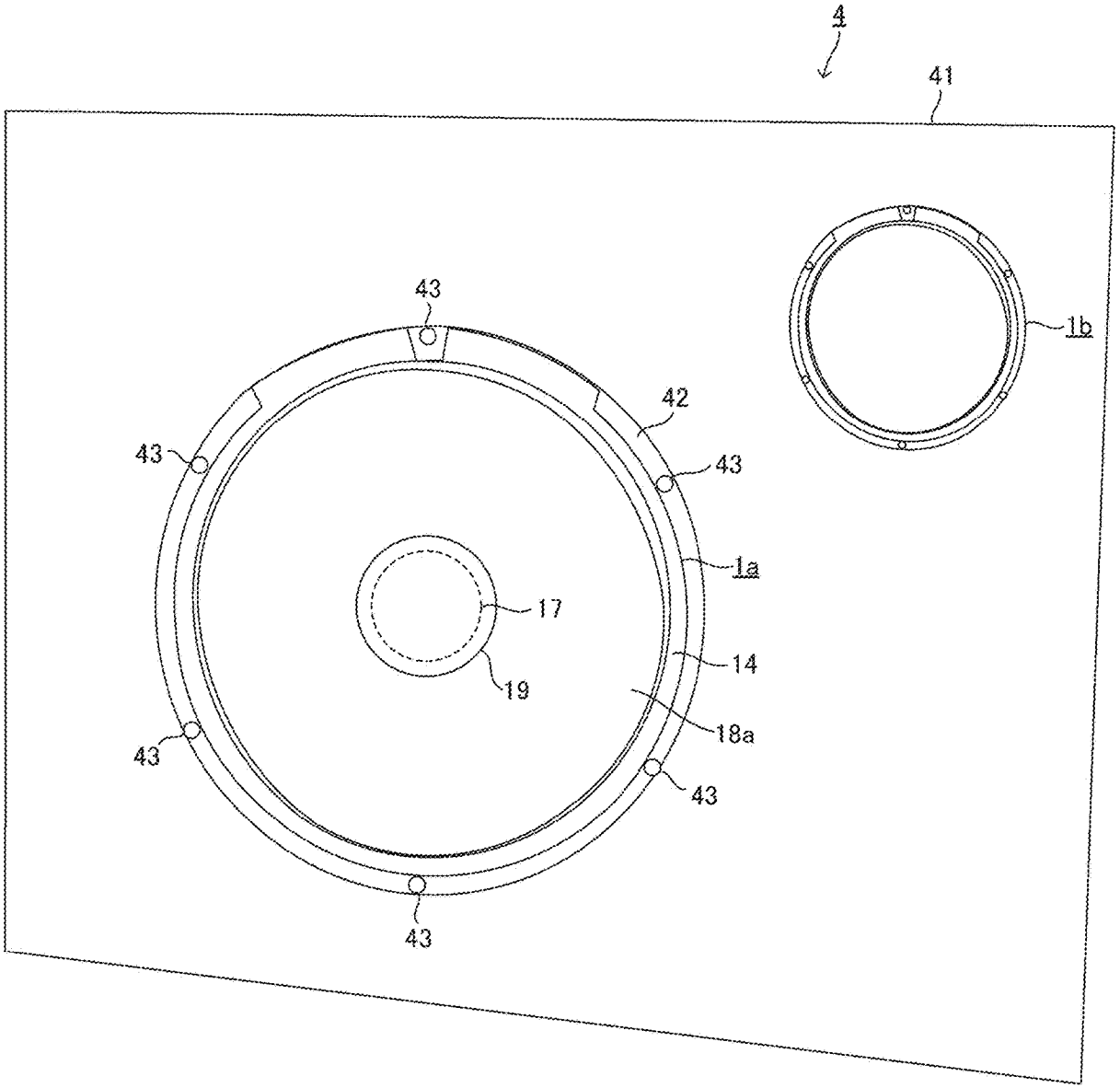
FIG. 13 is a front perspective view showing an outer appearance of the audio reproduction apparatus.
Figure 14:
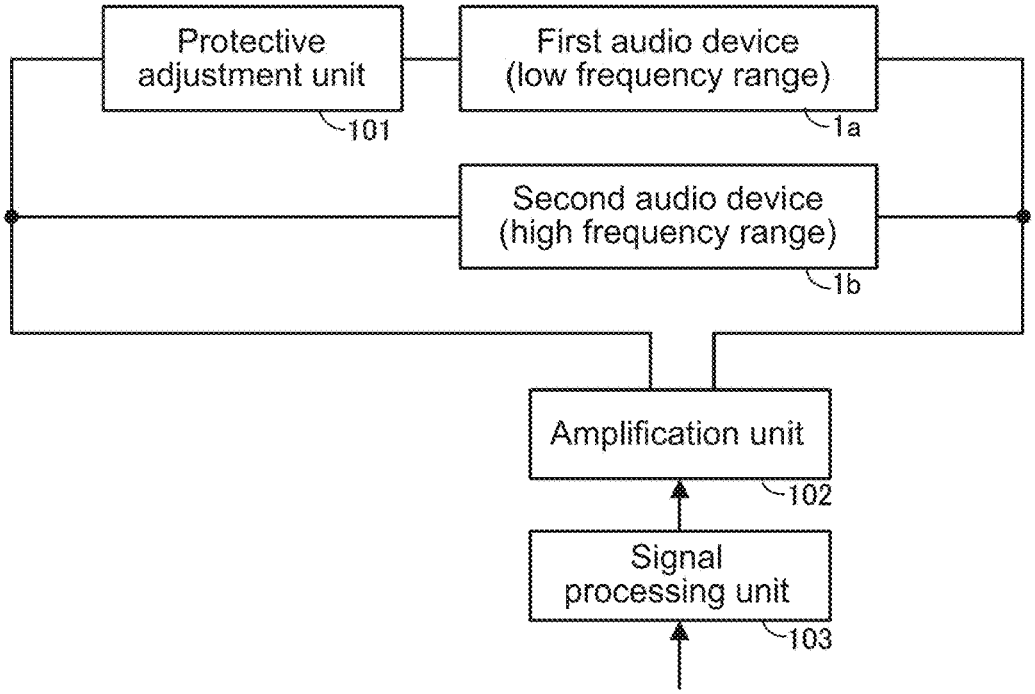
FIG. 14 is a block diagram showing a control configuration of the audio reproduction apparatus.

FIG. 13 and FIG. 14 are diagrams for describing a first modified example. FIG. 13 is a perspective view showing an audio reproduction apparatus 4 according to the first modified example. FIG. 14 is a block diagram showing a control configuration thereof. As shown in FIG. 13, the audio reproduction apparatus 4 according to the first modified example includes a first audio device 1*a* having a large aperture and in charge of the low frequency range and a second audio device 1*b* having a small aperture and in charge of the high frequency range.

The first audio device 1*a* and the second audio device 1*b* are both fixed to the frame base 41. A vibration front surface 18*a* of the first audio device 1*a* has a spherical coronal shape as in the above-mentioned embodiment, and is provided with the hole 17 and the closing portion 19 that closes the hole 17 at the center. On the other hand, although the vibration front surface of the second audio device 1*b* also has a spherical coronal shape, it has a configuration in which the hole is not provided. The configurations of the first audio device 1*a* and the second audio device 1*b* and the attachment configurations are similar to those of the above-mentioned embodiment, and thus the descriptions here will be omitted.

FIG. 14 is a diagram showing a control configuration of the audio reproduction apparatus 4 shown in FIG. 13. The electrodes (not shown) for the first audio device 1*a* and the second audio device 1*b* are connected in parallel with an output of one amplification unit 102 and are driven in accordance with a signal output from a signal processing unit 103. Further, a protective adjustment unit 101 constituted by a protection resistor for example is connected in series with the first audio device 1*a*. It should be noted that the second audio device 1*b* does not need to be provided with the protective adjustment unit 101.

A value of the protection resistor selected in the protective adjustment unit 101 is determined in consideration of the overall impedance and crossover characteristics. It should be noted that although the example in which the protective resistor is used for the protective adjustment unit 101 has been shown, an LPF configuration in which an inductor L is added other than such a form for example may be employed. Further, a configuration in which the protection adjustment unit is replaced by signal processing may be employed. For example, in the signal processing unit 103, a new audio signal may be generated by attenuating the high frequency range of an original acoustic signal and it may be supplied to the audio reproduction apparatus 4.

As shown in this first modified example, by providing the first audio device 1*a* and the second audio device 1*b* in the single audio reproduction apparatus 4, reproduction is exclusively performed from the first audio device 1*a* in the low middle range of the reproduction frequency band and reproduction is exclusively performed from the second audio device 1*b* in the high frequency range. Thus, it is possible to constitute the audio reproduction apparatus 4 having excellent acoustic characteristics in which the frequency band is wide.

Second Modified Example

Figure 15:
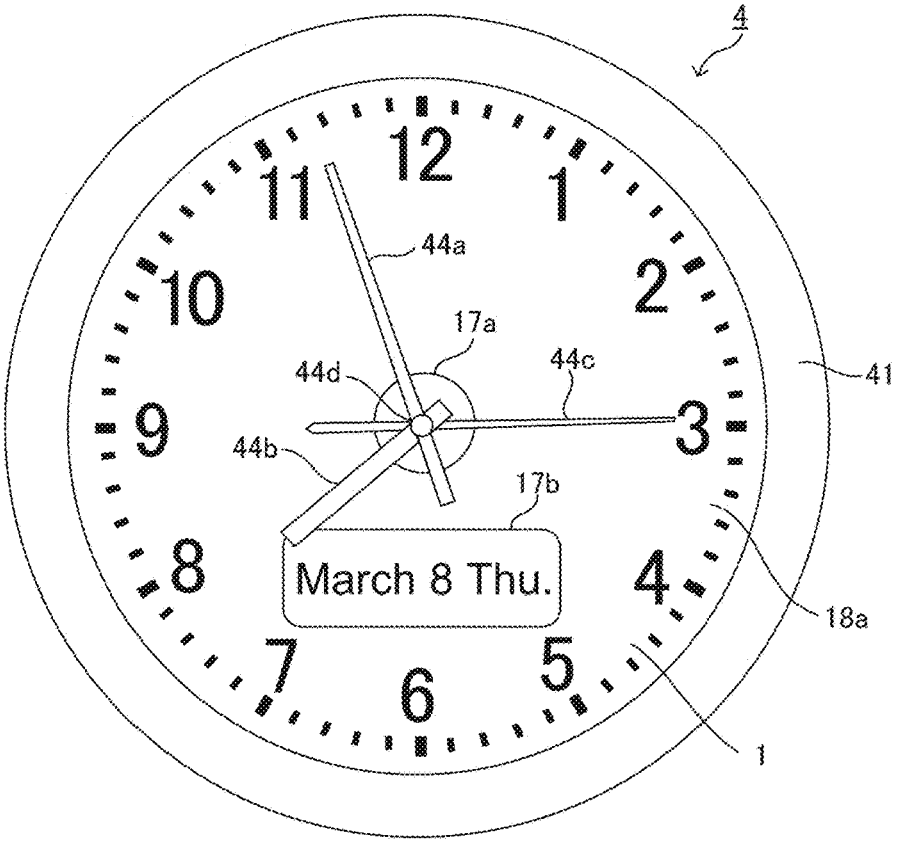
FIG. 15 is a diagram showing a use form of the audio reproduction apparatus.

FIG. 15 is a front view of an audio reproduction apparatus 4 according to a second modified example. The figure shows the face of a thin, wall-mounted clock constituted by the audio device 1. On the vibration front surface 18*a* of the audio device 1, colored numbers and the like are displayed. The audio device 1 that constitutes the face of the clock has a curved three-dimensional shape and has, for example, a spherical coronal shape as in the first embodiment.

On the face constituted by the audio device 1, there are provided a minute hand 44*a* and a hour hand 44*b* for indicating the time in the concentric portion and a hole 17*a* for passing a rotation shaft 44*d* for driving the second hand 44*c*. Further, a hole 17*b* for showing a date and a day of the week is provided on the face. A display unit for showing a date and a day of the week is provided on a back surface of the audio device 1, which is the face. It should be noted that although the hole 17*a* needs to communicate with the front and rear of the face, the hole 17*b* may be configured not to communicate by providing a transparent closing portion.

The hole 17*a* and the hole 17*b* contribute to improvement of the acoustic characteristics in the audio device 1. Further, although the colored numbers and the like are displayed on the vibration front surface 18*a*, the change in frequency characteristics due to the coloring does not appear remarkably and the effect on the acoustic characteristics is small. As shown in this second modified example, the audio reproduction apparatus 4 using the audio device 1 can be configured to be thin and light, and thus it is favorable for a wall-mounted decorative object.

Third Modified Example

Figure 16:
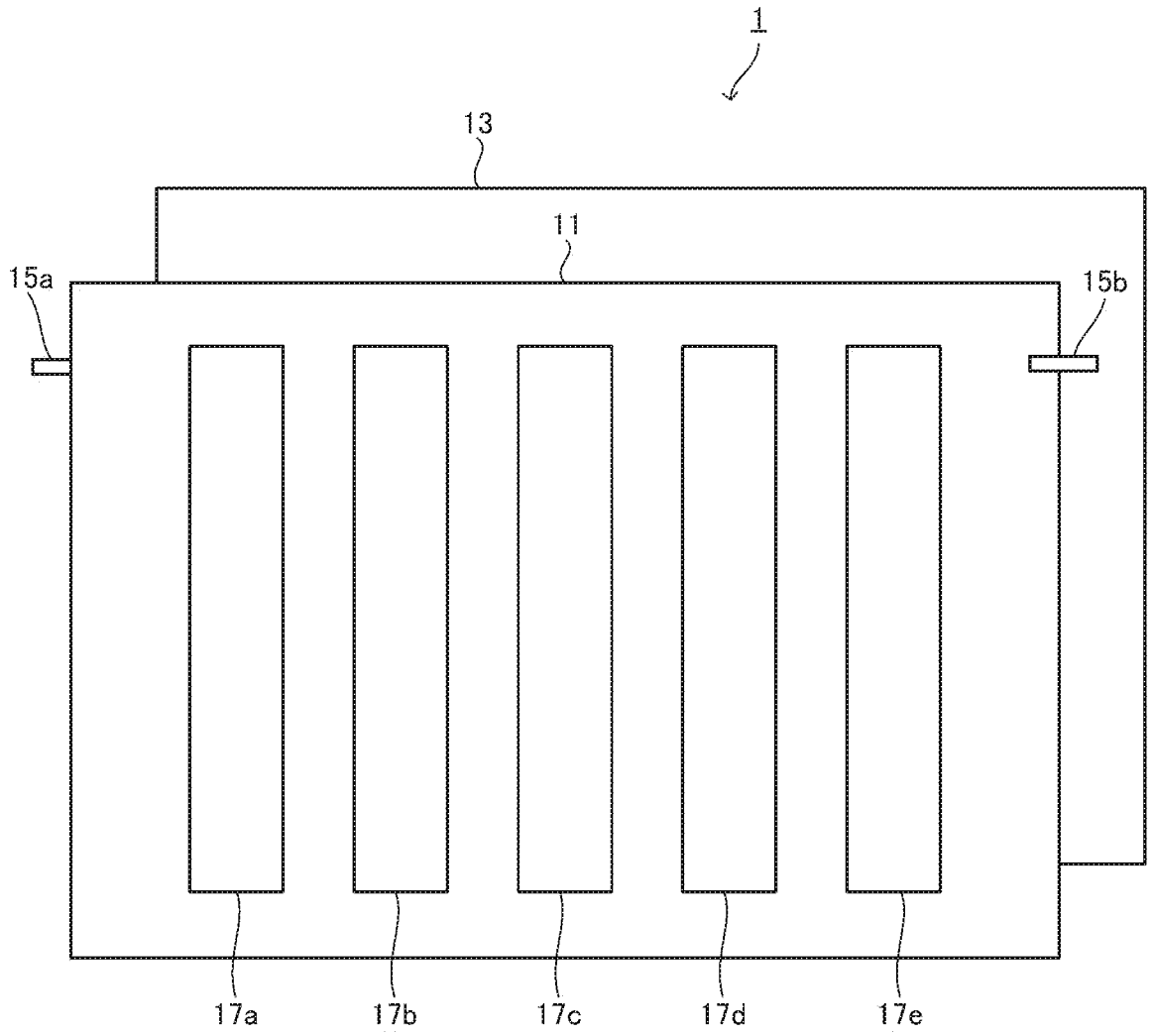
FIG. 16 is a plan view of the audio device before assembled.

Next, a third modified example will be described with reference to FIG. 16 to FIG. 18. FIG. 16 is a diagram for describing the audio device 1 that constitutes the third modified example. The audio device 1 according to the third modified example includes a reinforcing sheet 13 to be bonded to an acoustic sheet 11 and an acoustic sheet 12 formed of piezoelectric materials.

The size of the acoustic sheet 11 is A4 size in JIS standard. The acoustic sheet 11 is provided with rectangular holes 17*a* to 17*e* at a plurality of positions (five positions in the modified example) to form a region that is not actively driven in the acoustic sheet 11. Further, electrodes 15*a* and 15*b* are provided in the left and right of the acoustic sheet 11. The reinforcing sheet 13 is formed of a transparent (light transmissive) plastic plate having a thickness of about 0.5 mm and is bonded to the acoustic sheet 11 with an adhesive or the like. It should be noted that the material for the reinforcing sheet 13 can be selected as appropriate. Further, although the hole is not provided in the reinforcing sheet 13 in this modified example, the holes 17*a* to 17*e* may be provided at positions similar to the positions in the acoustic sheet 11 where the holes are provided. In that case, the reinforcing sheet 13 may be opaque.

Figure 17:
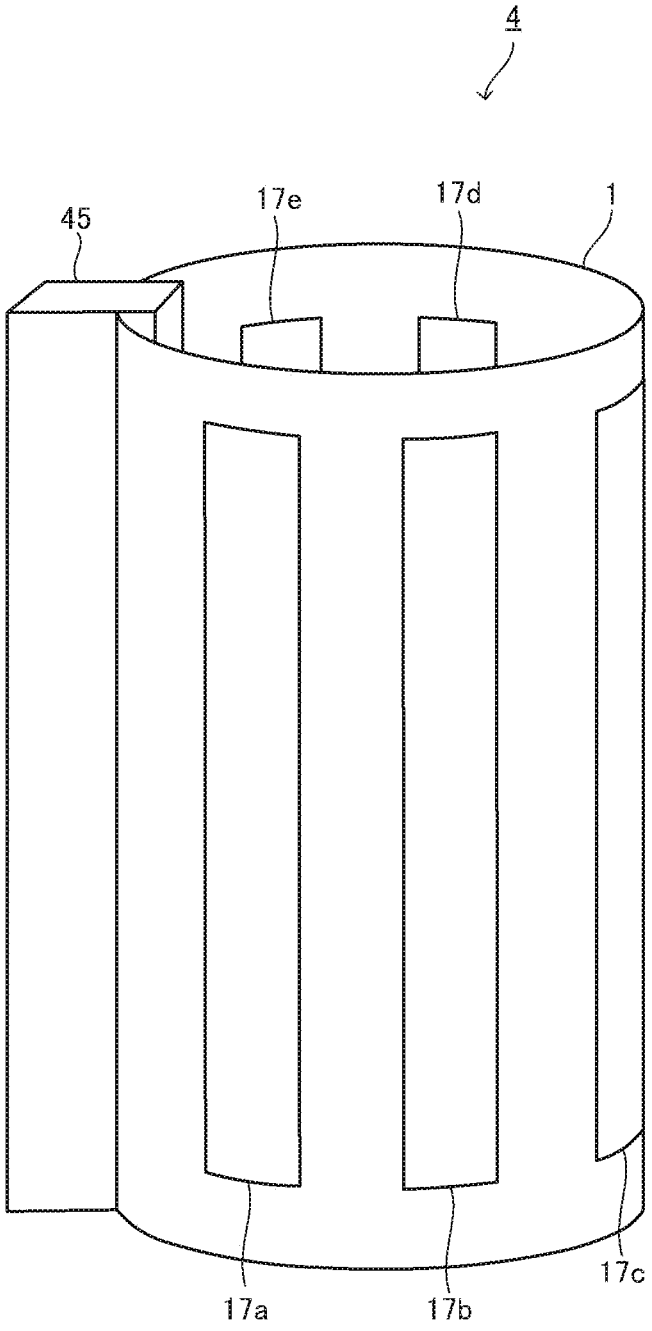
FIG. 17 is a perspective view showing an outer appearance of the audio reproduction apparatus.

FIG. 17 shows the audio reproduction apparatus 4 using the audio device 1 of FIG. 16, in which the audio device 1 of FIG. 16 is curved in a columnar shape and both the left right ends are fixed with a fixation portion 45. The fixation portion 45 has a function of fixing the audio device 1 as in the frame base 41 of the first embodiment and has a function of housing the electrodes 15*a* and 15*b* of the acoustic sheet 11 therein. Therefore, wirings for the electrodes 15*a* and 15*b* and an amplifier and the like to be connected to the wirings can be housed in the fixation portion 45 and a configuration excellent in design is provided without exposing the wirings and the amplifier and the like connected to the wirings.

Figure 18:
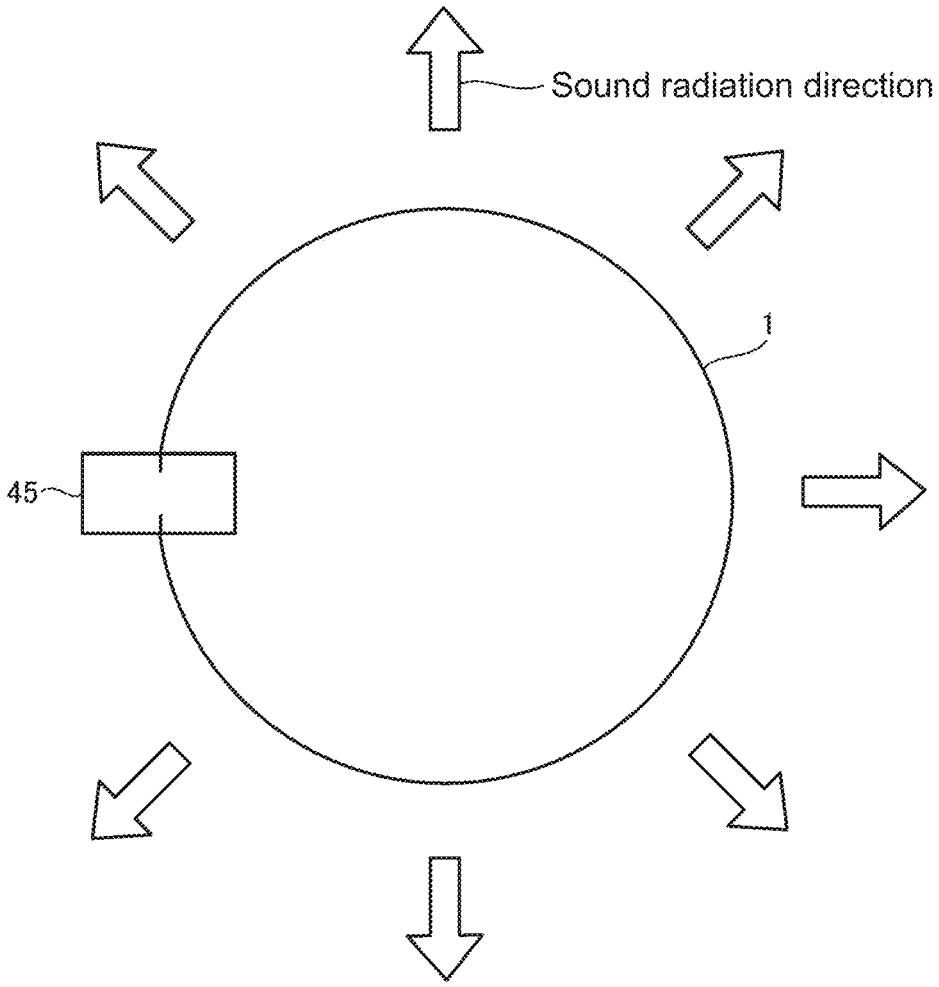
FIG. 18 is a top view of the audio reproduction apparatus.

FIG. 18 is a top view of the audio reproduction apparatus 4 of FIG. 17. In such an audio reproduction apparatus 4, since the sound is radiated over the surrounding substantially 360° from the acoustic sheet 11 formed in the columnar shape, the audio reproduction apparatus 4 having a wide directivity can be provided. For example, it is effective in public communication and the like in which a listener is not limited to a particular position. Further, an illumination portion may be provided inside the column formed by the audio device 1. It is possible to illuminate the surroundings with light leaking from above and below the audio device 1 and the holes 17*a* to 17*e*, and an apparatus having both a speaker function and an illumination function can be provided.

It should be noted that although the shape of each of the holes 17*a* to 17*e* provided in the acoustic sheet 11 is rectangular in the third modified example, an appropriate shape such as a circular shape, a semi-circular shape, and a parallelogram shape can be employed as the shape of each of the holes 17*a* to 17*e* or any pattern may be employed therefor. Further, any suitable positions, arrangement, and number of the holes 17*a* to 17*e* can be employed similarly.

Also in the third modified example, the holes 17*a* to 17*e*, i.e., the regions that are not actively driven are formed in the audio device 1 to achieve favorable acoustic characteristics in the audio device 1. It should be noted that although the audio device 1 has the shape curbed in the columnar shape in the third modified example, the shape to be curved is not limited to the columnar shape and various tubular shapes such as an inclined columnar shape that is an inclined cylindrical shape, a conical shape, and a shape obtained by cutting the top of the conical shape can be employed.

Thus, in the third modified example, a variety of applications such as arranging the illumination portion inside can be made with a wide directivity by curving the audio device 1 in the tubular shape. In addition, since the constraints on the design are well reduced, it is possible to realize the audio reproduction apparatus 4 in a novel design. It should be noted that in the third modified example, a configuration in which the audio device 1 is not provided with the holes 17*a* to 17*e*, i.e., the regions that are not actively driven in the acoustic sheet.

The present disclosure may also be realized by an apparatus, a method, a system, or the like. In addition, the matters described in the respective embodiments and modified examples can be combined as appropriate.

The present disclosure may also take the following configurations.

(1) An audio device, including a thin film material having a capacitive property, the thin film material including an acoustic sheet having a curved shape, in which the acoustic sheet includes a first region that is actively driven by an input signal and a second region that is not actively driven by the input signal and the first region is formed in at least a part of an outside of the second region.

(2) The audio device according to (1), in which the second region is a hole formed in the acoustic sheet.

(3) The audio device according to (1) or (2), in which the second region is formed of a material that is not actively driven.

(4) The audio device according to (3), in which a material that forms the second region is a flexible material.

(5) The audio device according to (3) or (4), in which a material that forms the second region is a light-transmissive material.

(6) The audio device according to any one of (1) to (5), in which the second region is provided substantially at a center of the first region.

(7) The audio device according to any one of (1) to (6), in which the second region is provided at a periphery of the first region.

(8) The audio device according to any one of (1) to (7), in which the second region comprises a plurality of second regions provided within the first region.

(9) The audio device according to any one of (1) to (8), in which the acoustic sheet has a shape curved in a convex form or a concave form in a sound radiation direction.

(10) The audio device according to any one of (1) to (8), in which the acoustic sheet has a shape curved in a tubular form.

(11) The audio device according to any one of (1) to (10), in which at least the first region is colored.

(12) The audio device according to any one of (1) to (11), in which the thin film material of the acoustic sheet has a film-like shape.

(13) The audio device according to any one of (1) to (12), further including a reinforcing sheet arranged to be superimposed on the acoustic sheet.

(14) An audio reproduction apparatus, including:

an acoustic sheet having a curved shape, the acoustic sheet being a thin film material having a capacitive property; and a fixation portion with which the acoustic sheet is fixed, in which the acoustic sheet includes a first region that is actively driven by an input signal and a second region that is not actively driven by the input signal and the first region is formed in at least a part of an outside of the second region.

(15) The audio reproduction apparatus according to (14), in which the acoustic sheet includes a holding portion extending in an outer peripheral direction, and the fixation portion fixes the acoustic sheet through the holding portion.

(16) The audio reproduction apparatus according to (14) or (15), in which the acoustic sheet has a shape curved in a tubular form, and the fixation portion fixes of both ends of the acoustic sheet.

(17) The audio reproduction apparatus according to any one of (14) to (16), further including a display unit that displays time information by using the second region.

(18) The audio reproduction apparatus according to any one of (14) to (17), further including an illumination portion that performs illumination by using the second region.

REFERENCE SIGNS LIST (1*a*, 1*b*) audio device
42 frame ring
4 audio reproduction apparatus
43 fixture
11 (11*a*, 11*b*) acoustic sheet
44*a* minute hand
11*a* vibration front surface
44*b* hour hand
12*a* vibration rear surface
44*c* second hand
13 reinforcing sheet
44*d* rotation shaft
14 holding portion
45 fixation portion
15*a*, 15*b*, 16*a*, 16*b* electrode
101 protective adjustment unit
17 (17*a* to 17*l*) hole
102 amplification unit
19 (19*a* to 19*l*) closing portion
103 signal processing unit
41 frame base (fixation portion)

The invention claimed is:

1. An audio device, comprising a thin film material having a capacitive property, the thin film material including an acoustic sheet having a curved shape, wherein the acoustic sheet includes a first region that is actively driven by an input signal and a second region that is not actively driven by the input signal and the first region is formed in at least a part of an outside of the second region, wherein the second region includes a hole formed in the acoustic sheet and the hole is covered with a material that is not actively driven.

2. The audio device according to claim 1, wherein the material that covers the hole is a flexible material.

3. The audio device according to claim 1, wherein the second region is provided substantially at a center of the first region.

4. The audio device according to claim 1, wherein the second region is provided at a periphery of the first region.

5. The audio device according to claim 1, wherein the second region comprises a plurality of second regions provided within the first region.

6. The audio device according to claim 1, wherein the acoustic sheet has a shape curved in a convex form or a concave form in a sound radiation direction.

7. The audio device according to claim 1, wherein the acoustic sheet has a shape curved in a tubular form.

8. The audio device according to claim 1, wherein at least the first region is colored.

9. The audio device according to claim 1, wherein the thin film material of the acoustic sheet has a film-like shape.

10. The audio device according to claim 1, further comprising a reinforcing sheet arranged to be superimposed on the acoustic sheet.

11. An audio reproduction apparatus, comprising:

an acoustic sheet having a curved shape, the acoustic sheet being a thin film material having a capacitive property; and a fixation portion with which the acoustic sheet is fixed, wherein the acoustic sheet includes a first region that is actively driven by an input signal and a second region that is not actively driven by the input signal and the first region is formed in at least a part of an outside of the second region, wherein the second region includes a hole formed in the acoustic sheet and the hole is covered with a material that is not actively driven.

12. The audio reproduction apparatus according to claim 11, wherein the acoustic sheet includes a holding portion extending in an outer peripheral direction, and the fixation portion fixes the acoustic sheet through the holding portion.

13. The audio reproduction apparatus according to claim 11, wherein the acoustic sheet has a shape curved in a tubular form, and the fixation portion fixes both ends of the acoustic sheet.

14. The audio reproduction apparatus according to claim 11, further comprising a display unit that displays time information.

* * * * *